US009945268B2

(12) United States Patent
Tomoda et al.

(10) Patent No.: US 9,945,268 B2
(45) Date of Patent: Apr. 17, 2018

(54) VARIABLE VALVE APPARATUS FOR INTERNAL COMBUSTION ENGINE

(71) Applicant: TOYOTA JIDOSHA KABUSHIKI KAISHA, Toyota-shi, Aichi-ken (JP)

(72) Inventors: Keiju Tomoda, Susono (JP); Yoshiaki Miyazato, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 12 days.

(21) Appl. No.: 15/074,455

(22) Filed: Mar. 18, 2016

(65) Prior Publication Data

US 2016/0273412 A1 Sep. 22, 2016

(30) Foreign Application Priority Data

Mar. 19, 2015 (JP) ..... 2015-056669

(51) Int. Cl.

| | |
|---|---|
| ***F01L 1/04*** | (2006.01) |
| ***F01L 1/08*** | (2006.01) |
| ***F01L 1/053*** | (2006.01) |
| ***F01L 13/00*** | (2006.01) |
| *F01L 1/18* | (2006.01) |

(52) U.S. Cl.

CPC ..... *F01L 1/08* (2013.01); *F01L 1/053* (2013.01); *F01L 13/0005* (2013.01); *F01L 1/185* (2013.01); *F01L 2013/001* (2013.01); *F01L 2013/10* (2013.01); *F01L 2105/00* (2013.01)

(58) Field of Classification Search

CPC ..... F01L 1/08; F01L 1/185; F01L 13/0005; F01L 2013/10

USPC ..... 123/90.16, 90.44, 90.6

See application file for complete search history.

(56) References Cited

U.S. PATENT DOCUMENTS

| | | | | |
|---|---|---|---|---|
| 9,581,052 | B2 * | 2/2017 | Maehara | F01L 1/34413 123/90.16 |
| 2015/0184560 | A1 | 7/2015 | Yano et al. | |
| 2016/0208661 | A1 | 7/2016 | Tomoda et al. | |

FOREIGN PATENT DOCUMENTS

| | | | |
|---|---|---|---|
| DE | 102009022642 | A1 | 12/2010 |
| GB | 2385888 | A | 9/2003 |
| JP | H05-231114 | A | 9/1993 |
| JP | 2008-095568 | A | 4/2008 |
| JP | 2009-264200 | A | 11/2009 |
| JP | 2016-130507 | A | 7/2016 |
| WO | 2014/030226 | A1 | 2/2014 |

* cited by examiner

*Primary Examiner* — Ching Chang

(74) *Attorney, Agent, or Firm* — Andrews Kurth Kenyon LLP

(57) ABSTRACT

A variable valve apparatus for an internal combustion engine according to the present invention comprises a cam base member rotating with rotation of a camshaft and a cam lobe member. The cam lobe member is movable to the cam base member, between a projecting position where the cam part radially projects and a retreat position where the cam part is retreated. A resilient member urges the cam lobe member toward the projecting position. A movement control apparatus includes a drive member provided for driving the cam lobe member, and the drive member is fixed to the cam lobe member. When the cam lobe member is in a non-fixing state to the cam base member, the cam lobe member is moved from the projecting position to the retreat position with the drive member being pressed.

9 Claims, 16 Drawing Sheets

VARIABLE VALVE APPARATUS FOR INTERNAL COMBUSTION ENGINE

CROSS-REFERENCES TO RELATED APPLICATIONS

This application claims the benefit of Japanese Patent Application No. 2015-056669, filed Mar. 19, 2015, which is hereby incorporated by reference wherein in its entirety.

BACKGROUND OF THE INVENTION

Field of the Invention

The present invention relates to a variable valve apparatus for an internal combustion engine.

Description of the Related Art

Conventionally there is well known a mechanism or an apparatus that varies a lift amount of an engine valve. WO2014/030226 discloses an example of an apparatus that varies a projecting amount of a cam in a cam shaft. This apparatus is provided with a cam base member rotated by a drive force from a crankshaft and a cam lobe member swingably connected to the cam base member. The cam lobe member is selectively positioned in any one of a retracting position of being stored in the cam base member and a projecting position of projecting radially outside from the cam base member according to an operating state of a hydraulic system. In the apparatus according to WO2014/030226, the lift amount of the engine valve is varied with this structure.

Here, an explanation will be made of the movement of a cam lobe member 102 to a cam base member 104 in the apparatus according to WO2014/030226 with reference to FIGS. 1A and 1B. FIG. 1A illustrates an example where the cam lobe member 102 is in the projecting position, and FIG. 1B illustrates an example where the cam lobe member 102 is in the retracting position. The cam lobe member 102 is regularly urged toward the projecting position by a spring (unillustrated). For regulating the projecting amount (that is, a swing range) of the cam lobe member 102 by the urging of the spring, a stopper pin 106 fixed in the cam lobe member 102 is arranged to be movable in a guide groove (elongated hole) 108 of the cam base member 104 along the longitudinal direction of the guide groove.

When supply of oil to a path upstream of a pin acting on the cam lobe member 102 is stopped not to apply a predetermined hydraulic pressure to the pin and the cam lobe member 102 is fixed in the projecting position to the cam base member 104, the cam lobe member 102 presses a rocker arm, thereby making it possible to open a valve (refer to a solid line in FIG. 2A). On the other hand, the oil is supplied to the path upstream of the pin acting on the cam lobe member 102 to apply the predetermined hydraulic pressure to the pin. Therefore when the cam lobe member 102 is fixed in the retracting position to the cam base member 104, the valve is not subjected particularly to a force in the opening direction (refer to a dotted line in FIG. 2A). This is because an outer surface of the cam base member 104 in FIGS. 1A and 1B has a shape based upon a reference circle. When the position of the cam lobe member 102 is changed from the projecting position to the retracting position, the hydraulic pressure is applied to the pin. In reverse, when the position of the cam lobe member 102 is changed from the retracting position to the projecting position, the hydraulic pressure applied to the pin is released.

When the hydraulic pressure applied to the pin is released, as long as the cam lobe member 102 does not become in the fixed state, the cam lobe member 102 continues to swing to the cam base member 104. FIG. 2B conceptually expresses the movement of the stopper pin 106 (that is, the movement of the cam lobe member 102) at the time the camshaft is rotating in a state where the cam lobe member 102 is not fixed. In a graph of FIG. 2B, the movement of the stopper pin 106 is expressed by a lost angle. The lost angle $\alpha$, as illustrated in FIG. 1B, corresponds to a rotating angle of the stopper pin 106 around a swing center (center of a supporting point member 110) of the cam lobe member 102 to the cam base member 104. The lost angle $\alpha$ is, as illustrated in FIG. 1A herein, defined as zero when the cam lobe member 102 is in the projecting position, and to be the larger as the position of the cam lobe member 102 comes closer to the retracting position.

As schematically illustrated in FIG. 2B, when the cam lobe member 102 is not fixed by the lock pin, the lost angle preferably changes as illustrated in the solid line. However, when the urging force of the spring is insufficient, in some cases a steep movement of the cam lobe member 102 immediately before the cam lobe member 102 reaches the projecting position, that is, in the latter part of the swinging movement cannot be realized by the urging force of the spring. In this case, the contact between the cam lobe member 102 and the rocker arm is once lost, and thereafter, the cam lobe member 102 reaches the projecting position. As a result, the stopper pin 106 collides with one end 108*a* of the guide groove 108 in the longitudinal direction in a speed faster than a ramp speed originally set (refer to the dotted line in FIG. 2B). Such collision between the members emits a collision noise when the internal combustion engine is operating in a low rotation (for example, in an idling operation), which is desired for an improvement.

Therefore an object of the present invention is to provide a variable valve apparatus for an internal combustion engine that can suppress a rapid movement of a cam lobe member to a cam base member.

SUMMARY OF THE INVENTION

According to an aspect of the present invention, there is provided a variable valve apparatus for an internal combustion engine that varies a lift amount of an engine valve comprising: a cam base member that is provided in a camshaft and rotates with rotation of the camshaft; a cam lobe member that has a cam part and is provided to be movable between a projecting position where the cam part projects radially out of the cam base member and a retreat position where the cam part is retreated from a front surface of the cam base member in relation to the cam base member; a first resilient member for urging the cam lobe member toward the projecting position; a movement control apparatus that is configured to control the movement of the cam lobe member to the cam base member and includes a drive member provided for driving the cam lobe member and a pressing part provided to add a pressing force to the drive member, the drive member being provided to be fixed to the cam lobe member and to be movable to the cam base member; and a fixing apparatus for selectively fixing the cam lobe member to the projecting position, wherein when the cam lobe member is in a non-fixing state to the cam base member, the cam lobe member is moved from the projecting position to the retreat position with the drive member being pressed by contact of the drive member with the pressing part.

According to the above aspect of the present invention, the cam lobe member provided to the cam base member is moved from the projecting position to the retreat position when the drive member on which the cam lobe member is fixed is pressed by contact with the pressing part. Since the drive member is separate from the cam lobe member designed to act on the engine valve, the degree of freedom in the design is high. Therefore according to the above aspect of the present invention, optimizing the shape of the drive member can produce an excellent effect of being capable of suppressing the rapid movement of the cam lobe member to the cam base member.

Preferably when the cam lobe member is fixed by the fixing apparatus, the cam lobe member starts to come in contact with the engine valve or a follower member connected to the engine valve during a period from a contact start to a contact end of the drive member with the pressing part with rotation of the camshaft.

Preferably when the cam lobe member is fixed by the fixing apparatus, the cam lobe member is released from a contact state with the engine valve or a follower member connected to the engine valve during a period from a contact start to a contact end of the drive member with the pressing part with rotation of the camshaft.

Preferably the pressing part is urged to press the drive member by a second resilient member.

Preferably the urging force of the second resilient member to the drive member is larger than the urging force of the first resilient member to the cam lobe member.

Preferably when the cam lobe member is fixed in the projecting position by the fixing apparatus, the drive member moves the pressing part against the urging force of the second resilient member by contact with the pressing part.

Preferably the variable valve apparatus for the internal combustion engine further comprises a regulating mechanism for regulating a movable range of the cam lobe member to the cam base member.

Preferably the cam lobe member is formed to have a forward end or backward end in both sides of the cam part in the rotating direction of the camshaft and is movable around a supporting point member to the cam base member, and the supporting point member is arranged in any one of the forward end and the backward end.

Preferably the cam lobe member and the drive member are connected through the supporting point member, and the drive member includes a concave curved part closer to the supporting point member and a convex curved part away from the concave curved part in the circumferential direction.

Further features of the present invention will become apparent from the following description of exemplary embodiments (with reference to the attached drawings).

BRIEF DESCRIPTION OF THE DRAWINGS

FIGS. 1A and 1B are diagrams illustrating a conventional variable valve apparatus, wherein FIG. 1A is a diagram illustrating a state where a cam lobe member is in a projecting position, and FIG. 1B is a diagram illustrating a state where the cam lobe member is in a retracting position;

FIGS. 14A to 14C are diagrams relating to an internal combustion engine to which a variable valve apparatus for an internal combustion engine according to a second embodiment of the present invention is applied, wherein FIG. 14A is a diagram illustrating lift curves of intake/exhaust valves, FIG. 14B is a diagram relating to a cam unit of the exhaust valve, and FIG. 14C is a diagram relating to a cam unit of the intake valve;

FIGS. 15A and 15B are diagrams explaining the configuration of the cam unit for the exhaust valve in the second embodiment, wherein FIG. 15A illustrates a state where a cam lobe member and a drive member are in a projecting position and FIG. 15B illustrate a state where the cam lobe member and the drive member are in a retreat position; and FIGS. 16A and 16B are diagrams explaining a modification of the cam unit for the exhaust valve in FIGS. 15A to 15B, wherein FIG. 16A illustrates a state where a cam lobe member is in a projecting position and FIG. 16B illustrate a state where the cam lobe member is in a retreat position.

DESCRIPTION OF THE EMBODIMENTS

Hereinafter an explanation will be made of embodiments of the present invention with reference to the accompanying drawings.

Figure 3:
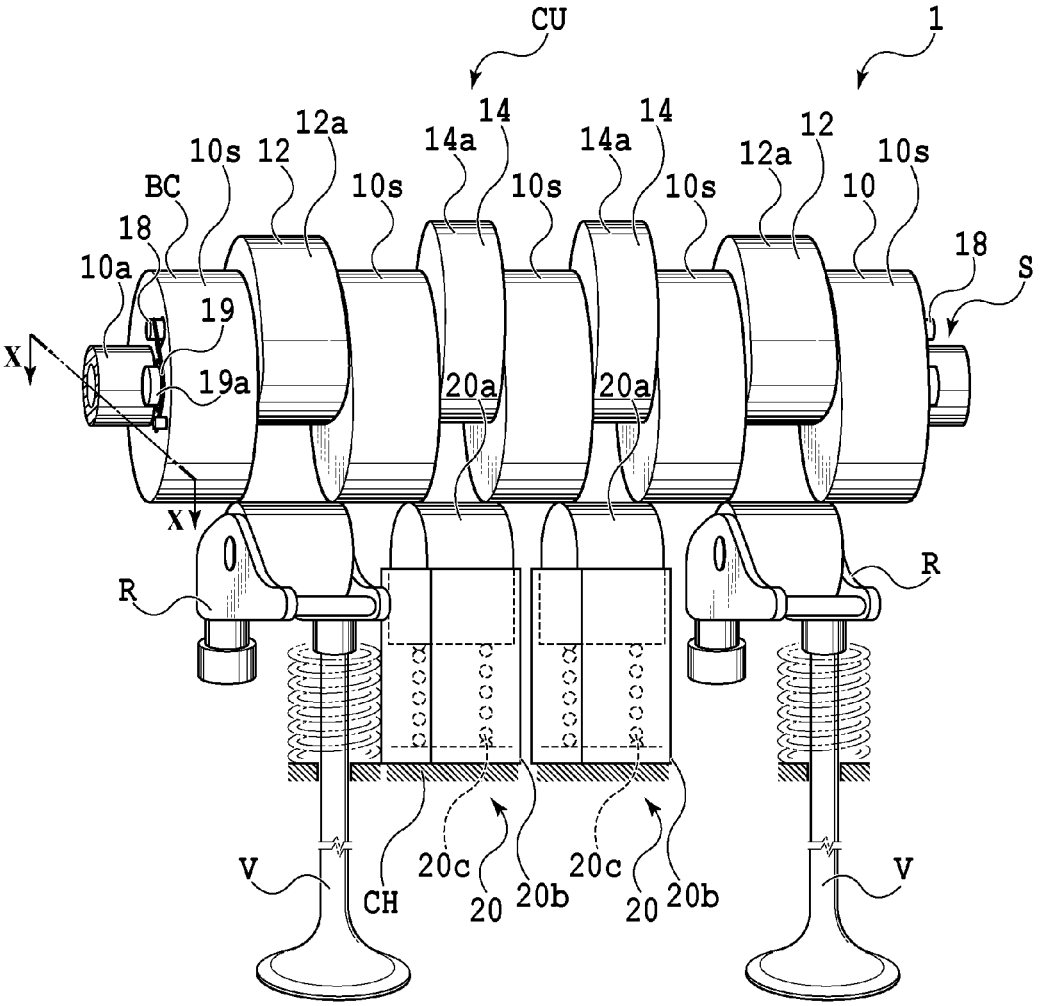
FIG. 3 is a diagram illustrating a substantial part of a variable valve apparatus for an internal combustion engine according to a first embodiment of the present invention.
Figure 4:
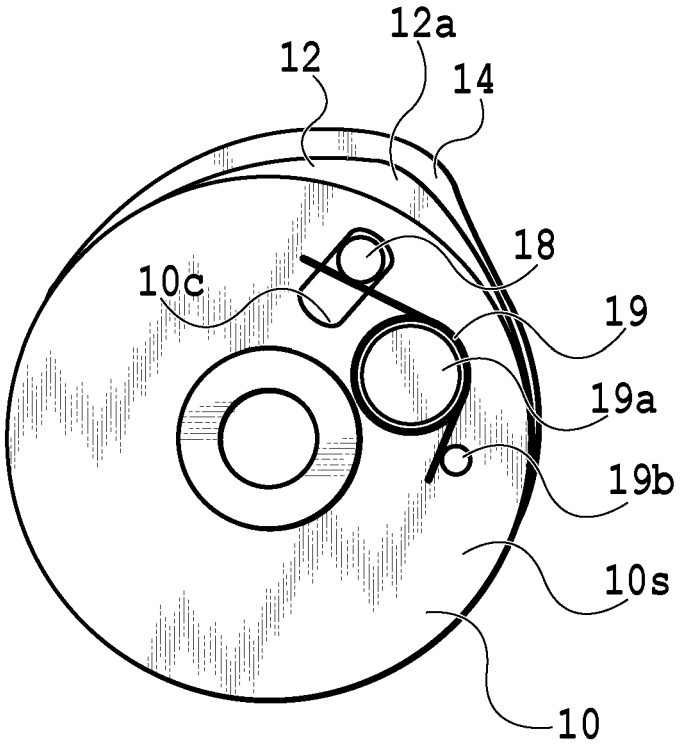
FIG. 4 is a diagram illustrating a cam unit of the variable valve apparatus in FIG. 3 as viewed in an axial direction thereof.

FIG. 3 is an outline view illustrating a variable valve apparatus 1 for an internal combustion engine according to a first embodiment of the present invention, and FIG. 4 is a diagram illustrating a cam unit in FIG. 3 as viewed in an axial direction of a camshaft. The variable valve apparatus 1 is applied to an internal combustion engine mounted on a vehicle. The internal combustion engine is a four-cylinder engine, but the present invention is not limited to the number of cylinders, the cylinder arrangement, the combustion type and the like of an internal combustion engine to be applied. In addition, the internal combustion engine to which the present invention is applied may be adopted in a machine other than a vehicle.

The variable valve apparatus 1 includes a camshaft S. The camshaft S an only part of which is shown in FIG. 3 is provided with a cam unit CU. The camshaft S rotates by power from the internal combustion engine. More specifically the camshaft S is rotated by a drive force from a crank shaft. It is possible to lift engine valves V through rocker arms R with rotation of the cam unit CU in association with the rotation of the camshaft S. Herein the valves V are intake valves for the internal combustion engine, but may be exhaust valves. It should be noted that the number of the cam units provided in the camshaft S corresponds to the number of cylinders in this embodiment, but is not limited to four, and may be one, two, three, five or more.

The cam unit CU is provided with a cam base member 10 having five sub cam base members 10*s*, two cam lobe members 12 and two drive members 14. It should be noted that the number of the cam lobe members 12 (or the drive members 14) provided for the cam base member 10 is not limited to two, and may be any number (for example one). The sub cam base members 10*s* line up in an axial direction of the camshaft S and are connected to each other by an inner shaft part 10*a*. The inner shaft part 10*a* is provided along the axis of the camshaft S. The cam base member 10 is larger in diameter than the inner shaft part 10*a*. The sub cam base member 10*s* is formed in a substantially cylindrical shape and has a base circle part BC (shape section corresponding to a reference base circle) with a substantially circular shape as viewed in the axial direction of the camshaft S (hereinafter, simply called "axial direction"). The base circle part BC corresponds to an outer peripheral surface of the cam base member 10. It should be noted that in the present specification, a direction perpendicular to the axial direction or a direction in parallel thereto about the axis of the camshaft S is called "radial direction". Further, a direction around the axis of the camshaft S or a direction similar thereto is called "circumferential direction".

Figure 2A:
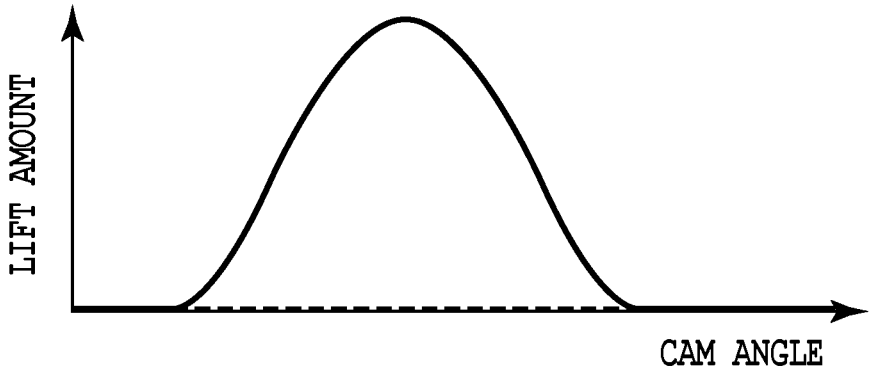
FIG. 2A is a graph illustrating a lift curve of the conventional variable valve apparatus.
Figure 6A:
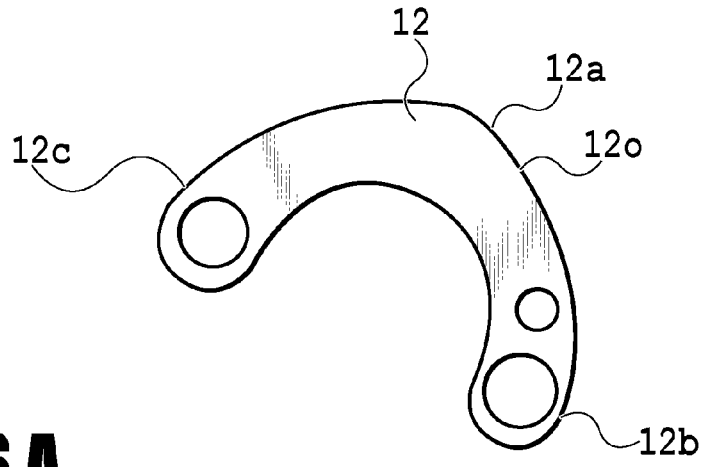
FIGS. 6A and 6B are diagrams illustrating the cam lobe member and the drive member in the variable valve apparatus of FIG. 3.

The cam lobe member 12 is arranged to be interposed between the sub cam base members 10*s* adjacent in the axial direction thereto. The cam lobe member 12 is structured to press the corresponding rocker arm R to lift the corresponding valve V (that is, move the corresponding valve V to open). Specifically the cam lobe member 12 is formed in a substantially U-letter shape in a cross section perpendicular to the axis of the camshaft S (refer to FIG. 6A) and is formed in a flat plate shape. The cam lobe member 12 has two opposing surfaces (hereinafter, end surfaces) arranged to be oriented in the axial direction and a surface (hereinafter, a peripheral side surface) extending between the end surfaces. The peripheral side surface has an outer peripheral surface 12*o* arranged to be oriented radially outside and an inner peripheral surface to be oriented radially inside (to the axis side of the camshaft S). The cam lobe member 12 includes a cam part 12*a* having a cam profile on the outer peripheral surface 12*o* and two ends at both the sides in the circumferential direction. The outer peripheral surface 12*o* of the cam part 12*a* has a cam profile corresponding to a lift curve as illustrated in a solid line in FIG. 2A. It should be noted that here, among the two ends of the cam lobe member 12, an end 12*b* positioned forward (that is, at the advanced angle side) in the rotating direction of the camshaft S is called a forward end and an end 12*c* positioned backward (that is, at the retarded angle side) in the rotating direction of the camshaft S is called a backward end.

Figure 5:
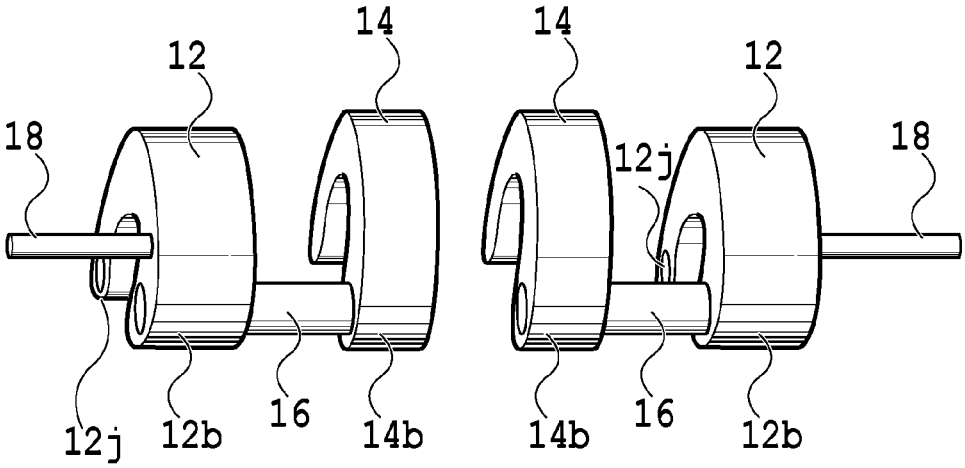
FIG. 5 is a diagram illustrating an assembly composed of two pairs of cam lobe members and drive members in the arrangement of FIG. 3.

The drive member 14 is arranged to be interposed between the sub cam base members 10*s* adjacent in the axial direction thereto. The drive member 14 is fixed to the cam lobe member 12 paired thereto to interpose one sub cam base member 10*s* between the drive member 14 and the cam lobe member 12. FIG. 5 illustrates two pairs of assemblies (or sets) composed of the cam lobe members 12 and the drive members 14 in FIG. 3 in the arrangement illustrated in FIG. 3.

Figure 6B:
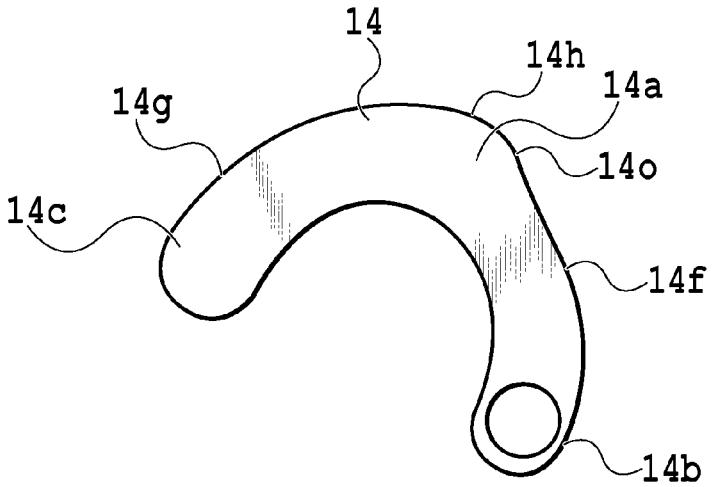

The cam lobe member 12 is connected fixedly to the drive member 14 by a support shaft (a supporting point member) 16. The drive member 14 has a shape approximately corresponding to the cam lobe member 12. Specifically the drive member 14 is formed in a substantially U-letter shape in a cross section perpendicular to the axis of the camshaft S (refer to FIG. 6B). The drive member 14 has two opposing surfaces (hereinafter, end surfaces) arranged to be oriented in the axial direction and a surface (hereinafter, a peripheral side surface) extending between the end surfaces. The peripheral side surface has an outer peripheral surface arranged to be oriented radially outside and an inner peripheral surface to be oriented radially inside (that is, to the axis side of the camshaft S). The drive member 14 includes a pressed part 14*a* having a profile for driving the can lobe member 12 on an outer peripheral surface 14*o* and two ends at both the sides in the circumferential direction. The pressed part 14*a* is structured of being pressed mainly by a pressing apparatus to be described later, but may apply the reverse force. It should be noted that here, among the two ends of the drive member 14, an end 14*b* positioned forward (that is, at the advanced angle side) in the rotating direction of the camshaft S is called a forward end and an end 14*c* positioned backward (that is, at the retarded angle side) in the rotating direction of the camshaft S is called a backward end.

The support shaft 16 is arranged to connect the forward end 12*b* of the cam lobe member 12 and the forward end 14*b* of the drive member 14. It should be noted that the support shaft 16 is arranged in such a manner that the axis of the support shaft 16 is in parallel to the axis of the camshaft S. The support shaft 16 is inserted into a through hole 10*b* provided in the sub cam base member 10*s* between the cam lobe member 12 and the drive member 14 paired thereto, and is provided to be movable to the cam base member 10. As a result, the cam lobe member 12 and the drive member 14 are movable to the cam base member 10, particularly about the support shaft 16.

Further, a stopper pin 18 projecting in the axial direction is fixed to the cam lobe member 12. The stopper pin 18 is a rod-shaped member. Here, the stopper pin 18 projects from the vicinity of the forward end 12*b* of the cam lobe member 12 to a side different from the associated drive member 14. It should be noted that the stopper pin 18 is also provided in parallel to the axis of the camshaft S as similar to the support shaft 16. The stopper pin 18 is inserted in a guide hole (elongated hole) 10*c* of the sub cam base member 10*s* in a side different from the associated drive member 14 and projects in the axial direction. The guide hole 10*c* is designed to define a range (movable range) where the cam lobe member 12 and the drive member 14 are allowed to move to the cam base member 10, and the stopper pin 18 can move from one end to the other end of the guide hole 10*c* along the longitudinal direction thereof. Since the movement of the cam lobe member 12 and the movement of the drive member 14 are regulated within the movable range of the stopper pin 18 in the guide hole 10*c*, the guide hole 10*c* and the stopper pin 18 constitute a regulating mechanism for regulating the movable range of the cam lobe member 12 to the cam base member 10. Therefore the cam lobe member 12 and the drive member 14 are swingable to the cam base member 10 within the movable range of the stopper pin 18 in the guide hole 10*c*.

A first spring (first resilient member) 19 is arranged on an axial outside end surface of each of the sub cam base members 10*s* at both the sides of the five sub cam base members 10*s*. The first spring 19 is arranged to urge the stopper pin 18 in a direction for projecting the cam part 12*a* of the cam lobe member 12 radially outside from the outer peripheral surface of the cam base member 10. It should be noted that the first spring 19 is provided around a shaft part 19*a* provided to project from the cam base member 10, and one end thereof presses a fixed shaft part 19*b* provided to project from the cam base member 10 and the other end urges the stopper pin 18. Therefore, with this first spring 19, the cam lobe member 12 is urged toward the projecting position where the cam part 12*a* projects radially from the cam base member 10. This structure is true of the drive member 14 fixed to the cam lobe member 12.

Further, pressing apparatuses 20 are provided radially outside of the drive members 14. In the present embodiment, the pressing apparatuses 20 are provided on a cylinder head CH. It should be noted that the pressing apparatus 20 is not limited to be provided on the cylinder head CH, but may be provided in the other location. The pressing apparatus 20 has a lifter (pressing part) 20*a* provided to be contactable with or to be able to abut on the drive member 14 in such a manner as to be able to apply a pressing force to the drive member 14. The lifter 20*a* is arranged in a boss member 20*b* as a tubular guide member, and is supported by a second spring (resilient member) 20*c* in the boss member 20*b* to be movable forward/backward to the cam base member 10. The lifter 20*a* is structured with an axial dimension longer than the lateral width of the drive member 14, making it possible to continue to apply the pressing force to the sub cam base members 10*s* at both the sides of the drive member 14. As a result, when the drive member 14 rotates with rotation of the camshaft S to cause the pressed part 14*a* of the drive member 14 to start to come in contact with the lifter 20*a*, the pressed part 14*a* is subjected to the pressing force from the lifter 20*a*. Since the urging force of the second spring 20*c* to the drive member 14 through the lifter 20*a* is larger than the urging force from the first spring 19, when the pressed part 14*a* of the drive member 14 starts to come in contact with the lifter 20*a* to further rotate, the drive member 14 is moved from the projecting position where the pressed part 14*a* projects radially outside of the cam base member 10 to the retreat position where the pressed part 14*a* retreats radially inside from the outer peripheral surface of the cam base member 10. In addition, when the pressed part 14*a* further rotates, the pressed part 14*a* comes out of the contact state with the lifter 20*a* and the drive member 14 returns back to the projecting position.

The pressed part 14*a* of the drive member 14, particularly the outer peripheral surface 14*o* is formed such that the cam lobe member 12 can smoothly swing around the support shaft 16. The pressed part 14*a* has a concave curved part 14*f* (closer to the support shaft 16), a convex curved part 14*g* and a transition part 14*h* extending therebetween. The concave curved part 14*f*, the transition part 14*h* and the convex curved part 14*g* are arranged to line up along the circumferential direction of the outer peripheral surface of the drive member 14. Therefore the concave curved part 14*f* is separated from the convex curved part 14*g* in the circumferential direction of the cam lobe member 12. The transition part 14*h* can be formed to connect the concave curved part 14*f* and the convex curved part 14*g* and to be fitted in the base circle part BC. The concave curved part 14*f* is closer to the support shaft 16 than the convex curved part 14*g*. In the example illustrated herein, the concave curved part 14*f* is positioned in the forward side in the rotating direction (in the rotating direction of the camshaft S) of the transition part 14*h* and the convex curved part 14*g* is positioned in the backward side in the rotating direction of the transition part 14*h*. As a result, when the lifter 20*a* of the pressing apparatus 20 presses the drive member 14 toward a radial inside of the cam shaft S along the concave curved part 14*f* of the pressed part 14*a*, the drive member 14 moves toward the retreat position (refer to FIG. 7B). On the other hand, when the lifter 20*a* continues to press the drive member 14 along the convex curved part 14*g* of the pressed part 14*a*, the drive member 14 moves to the projecting position (refer to FIG. 7A) such that the pressed part 14*a* projects from the outer surface of the cam base member 10.

Figure 7A:
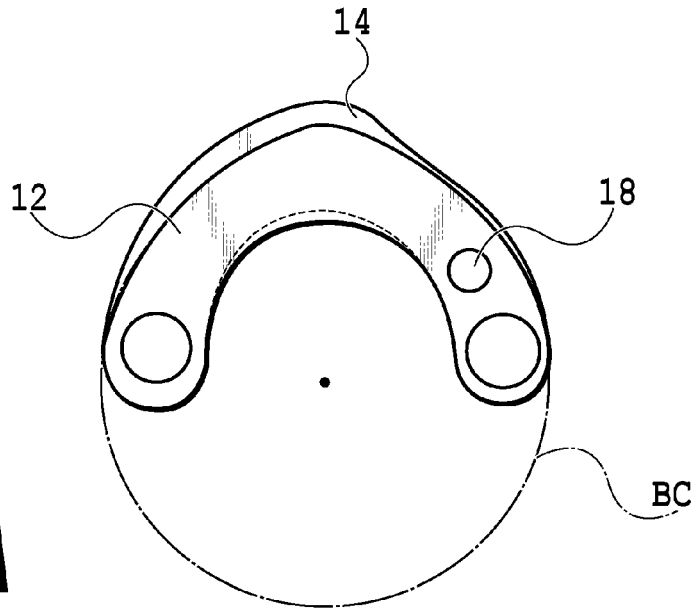
FIG. 7A is a diagram illustrating a state where a pair of the cam lobe member and the drive member each are in a projecting position.
Figure 7B:
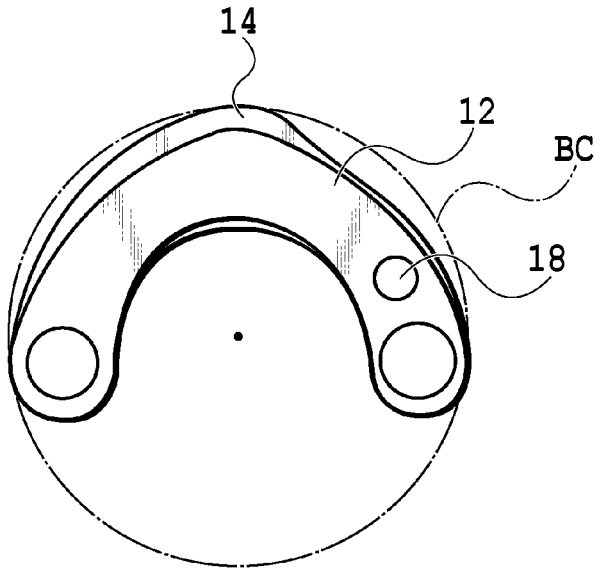
FIG. 7B is a diagram illustrating a state where the pair of the cam lobe member and the drive member each are in a retracting position.

As described above, since the cam lobe member 12 is fixed on the drive member 14, when the drive member 14 is moved from the projecting position to the retreat position, the cam lobe member 12 also is, as illustrated in FIGS. 7A and 7B, moved from the projecting position (refer to FIG. 7A) to the retreat position (refer to FIG. 7B) where the cam part 12*a* retreats to the radial inside from the outer peripheral surface of the cam base member 10. It should be noted that in the present embodiment, with the movement of the cam lobe member 12 toward the retreat position, the cam lobe member 12 becomes in a state of being not in contact with the rocker arm R completely. In this way, the drive member 14 fixed to the cam lobe member 12 and the pressing apparatus 20 cooperate to control the movement of the cam lobe member 12 to the cam base member 10, which constitute a movement control apparatus in the present invention.

Figure 8:
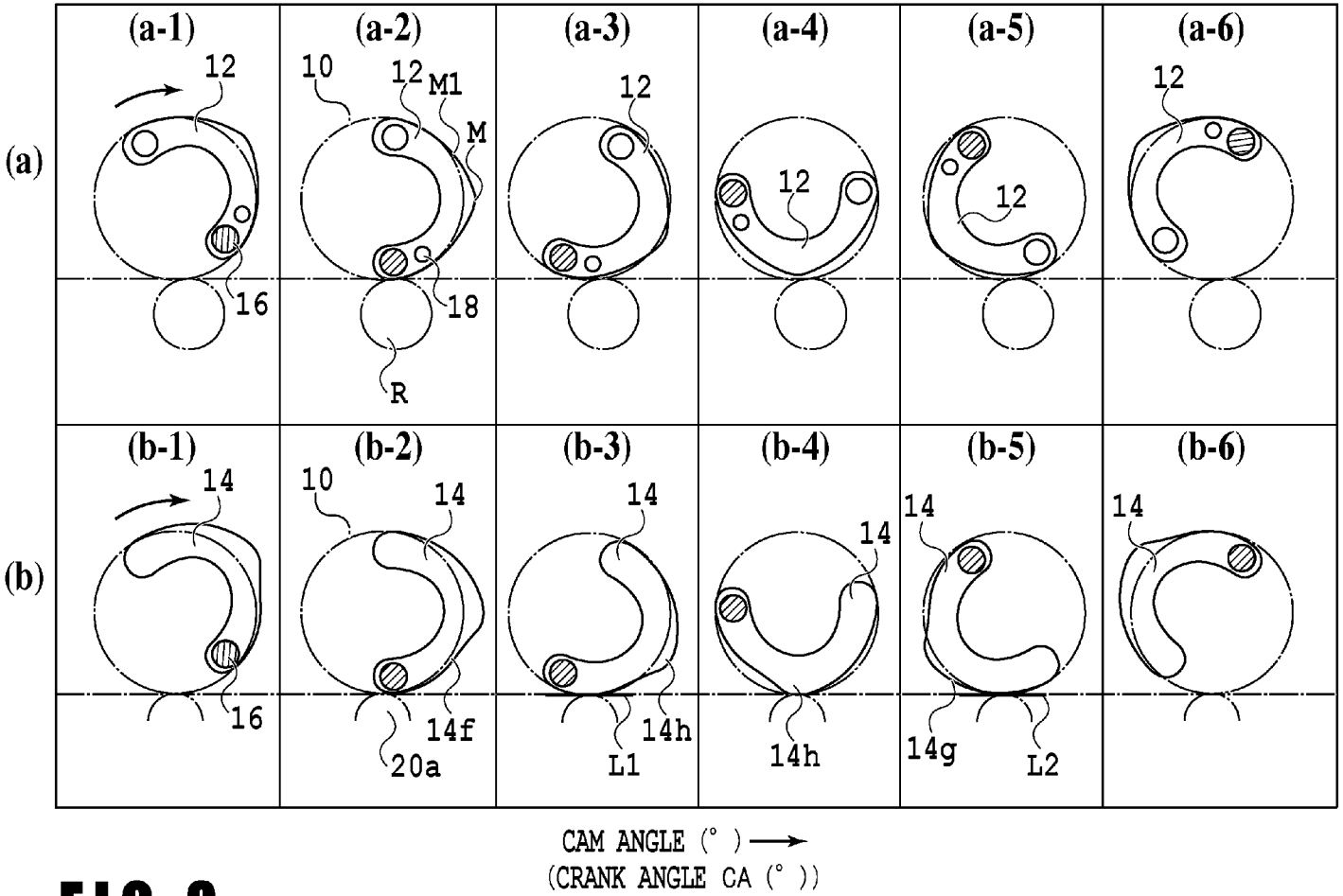
FIG. 8 is a diagram illustrating, in a stepwise manner, the movement of the cam lobe member and the movement of the drive member in the variable valve apparatus of FIG. 3 in a non-fixing state.

An explanation will be further made of a reciprocal motion (swinging motion) of the cam lobe member 12 and the drive member 14 to the cam base member 10 within a given range as described above, with reference to FIG. 8. However, the movement of the cam lobe member 12 to the cam base member 10 in a row (a) of FIG. 8 is performed in cooperation with the movement of the drive member 14 (fixed to the cam lobe member 12 in the row (a) of FIG. 8) to the cam base member 10 in a row (b) of FIG. 8. The cam lobe member 12 and the drive member 14 lining up upward/downward in FIG. 8 have the same cam angle (that is, the same crank angle CA(°)). That is, in FIG. 8, (a-1) and (b-1) illustrate the movements at the same timing, and the same is applied to each combination of from (a-2) and to (a-6) and from (b-2) and to (b-6). It should be noted that in FIG. 8, the support shaft 16 or the part equivalent thereto is hatched for easy understanding. In FIG. 8, for example, in (a-1) the cam lobe member 12 is in the projecting position, in (b-1) the drive member 14 is in the projecting position, in (a-4) the cam lobe member 12 is in the retreat position and in (b-4) the drive member 14 is in the retreat position.

As apparent from the figure, when the pressed part 14*a* of the drive member 14 is pressed by the lifter 20*a*, since the drive member 14 moves from the projecting position to the retreat position, the position of the lifter 20*a* does not change. As a result, since the cam lobe member 12 interlocking with the drive member 14 moves likewise from the projecting position to the retreat position, only the outer peripheral surface of the cam base member 10 comes in sliding contact with the rocker arm R, and the valve V is kept on being closed. It should be noted that the reciprocal motion (swinging motion) of the cam lobe member 12 and the drive member 14 to the cam base member 10 within a given range as illustrated in FIG. 8 is repeated with rotation of the camshaft S unless the cam lobe member 12 is fixed to the cam base member 10 by the fixing apparatus 24 which will be explained next.

Further, there is provided the fixing apparatus 24 for selectively fixing the cam lobe member 12 to the cam base member 10. With the fixing apparatus 24, the cam lobe member 12 (and the drive member 14) can selectively take the state (fixing state) where the cam lobe member 12 is fixed to the cam base member 10 and the state (non-fixing state or free state) where the cam lobe member 12 is non-fixed to the cam base member 10. The movement of the cam lobe member 12 and the movement of the drive member 14 when the cam lobe member 12 is in the non-fixing state are performed as already explained with reference to FIG. 8. On the other hand, the fixing apparatus 24 is structured in such a manner as to be capable of fixing the cam lobe member 12 to the projecting position.

Figure 9:
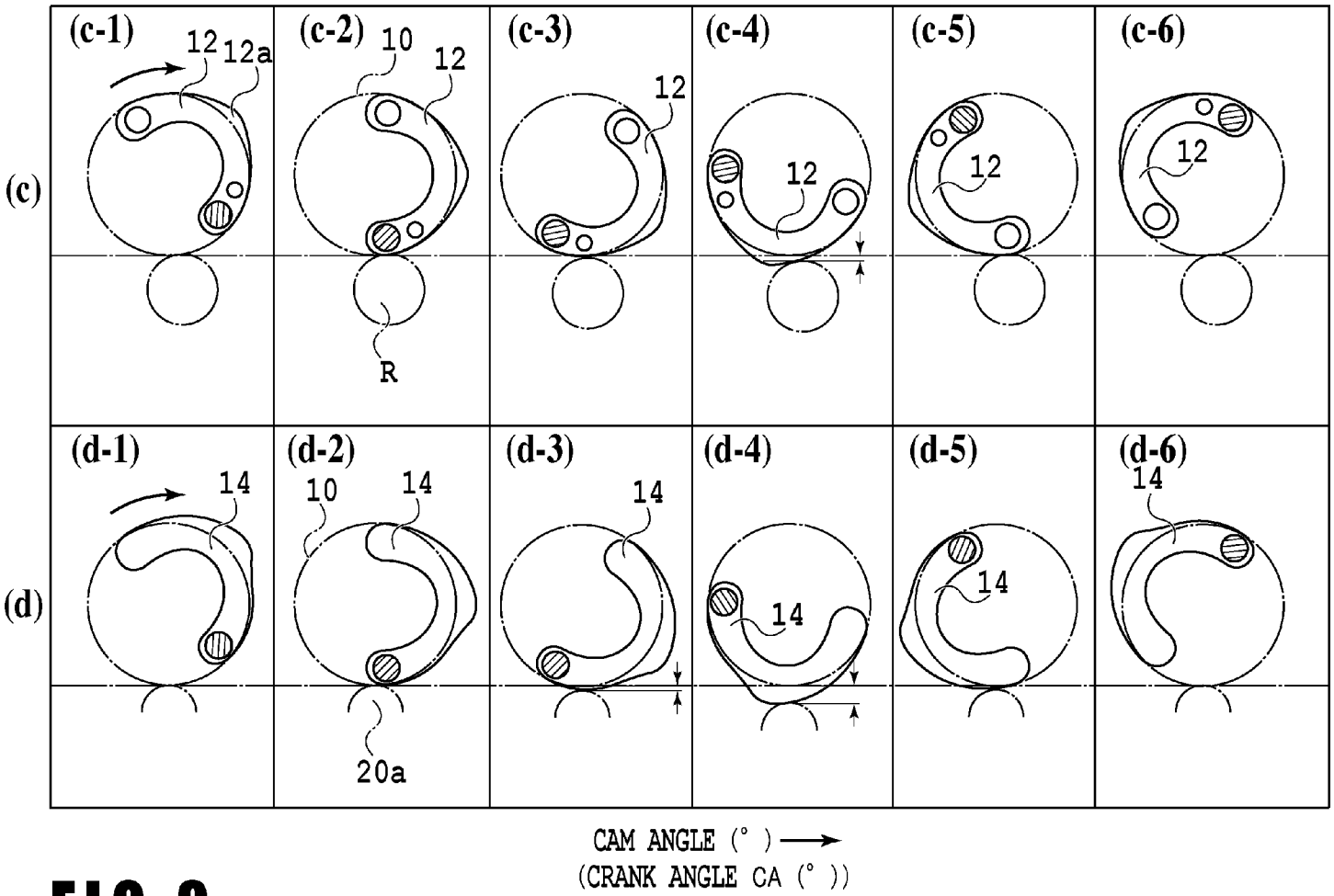
FIG. 9 is a diagram illustrating, in a stepwise manner, the movement of the cam lobe member and the movement of the drive member in the variable valve apparatus of FIG. 3 in a fixing state.

The movement of the cam lobe member 12 and the movement of the drive member 14 when the cam lobe member 12 is in the fixing state by the fixing apparatus 24 are illustrated in FIG. 9, in the same manner as in FIG. 8. The cam lobe member 12 and the drive member 14 both are in the corresponding projecting positions when the cam lobe member 12 is in the fixing state, and respectively act on the rocker arm R and the lifter 20*a*. As illustrated in a row (c) in FIG. 9, the cam lobe member 12 can press down the rocker arm R with the cam part 12*a*. As a result, the valve V opens as illustrated in the solid line in FIG. 2A. On the other hand, as illustrated in a row (d) of FIG. 9, when the drive member 14 acts on the lifter 20*a* with the pressed part 14*a*, the lifter 20*a* is pressed down into the boss member 20*b* against the urging force of the second spring 20*c*. Therefore when the cam lobe member 12 acts to open the valve in this way, the drive member 14 fixed to the cam lobe member 12 does not interrupt the movement of the cam lobe member 12. It should be noted that in FIG. 9, (c-1) and (d-1) illustrate the movements at the same timing, and the same is applied to each combination of from (c-2) and to (c-6) and from (d-2) and to (d-6).

Figure 10:
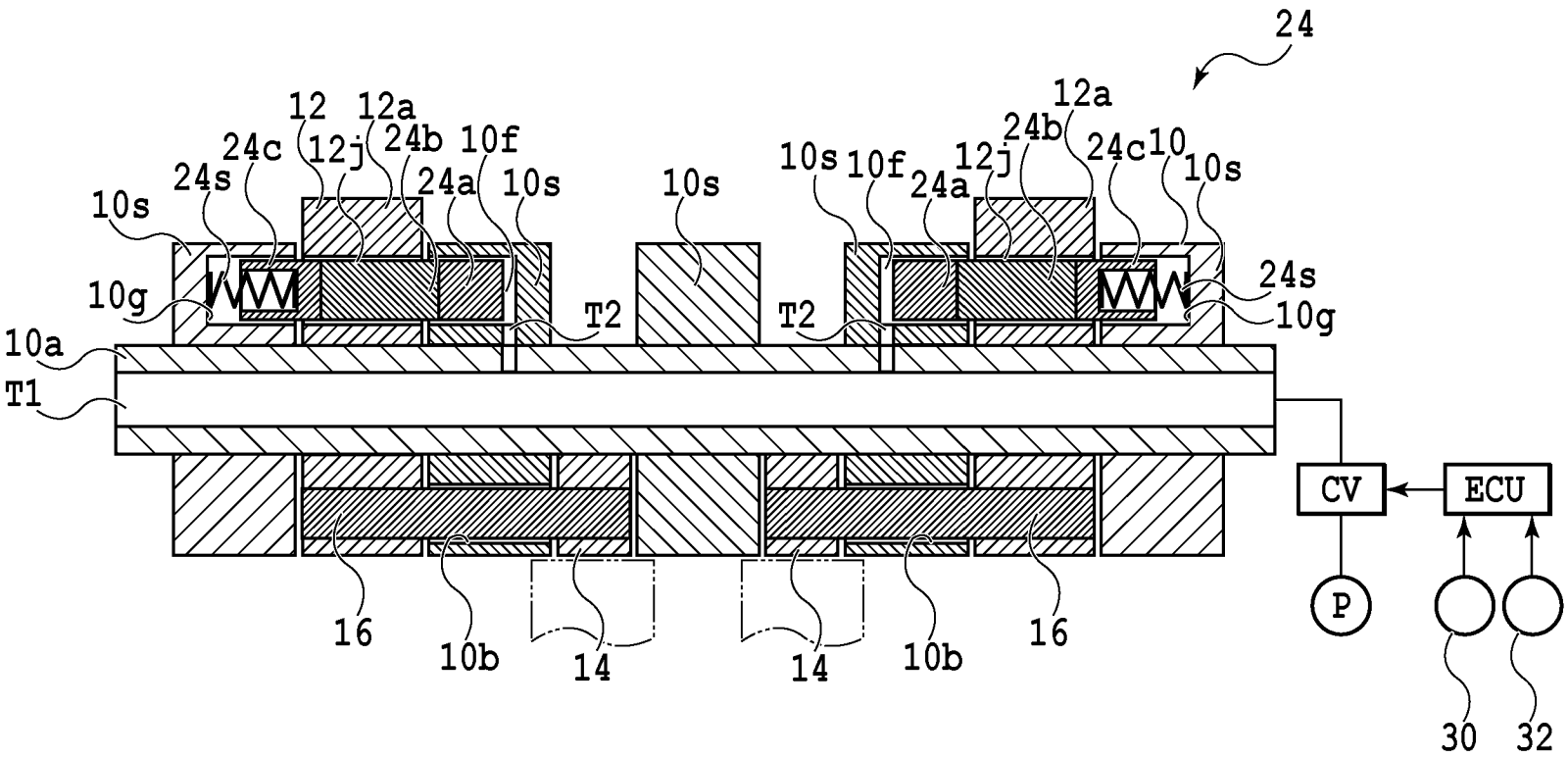
FIG. 10 is a cross section taken along an X-X line in FIG. 3, and is a schematic diagram explaining a fixing mechanism for fixing the cam lobe member in the variable valve member in FIG. 3.
Figure 11:
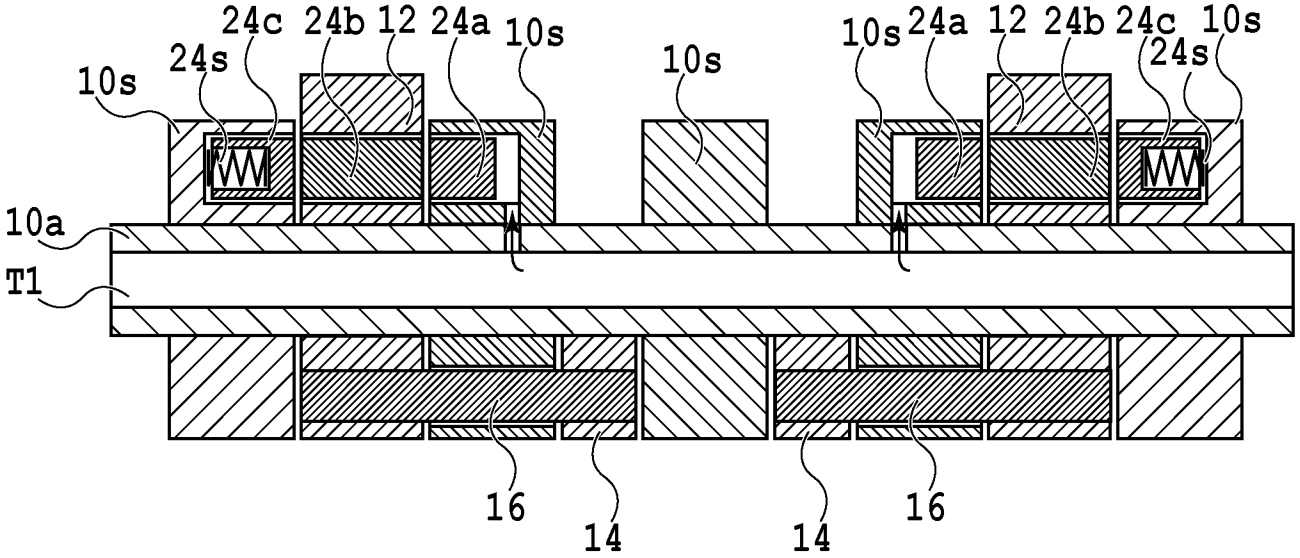
FIG. 11 is a diagram illustrating a state where a hydraulic pressure is applied to pins in the fixing mechanism in the cross section of FIG. 10.
Figure 12:
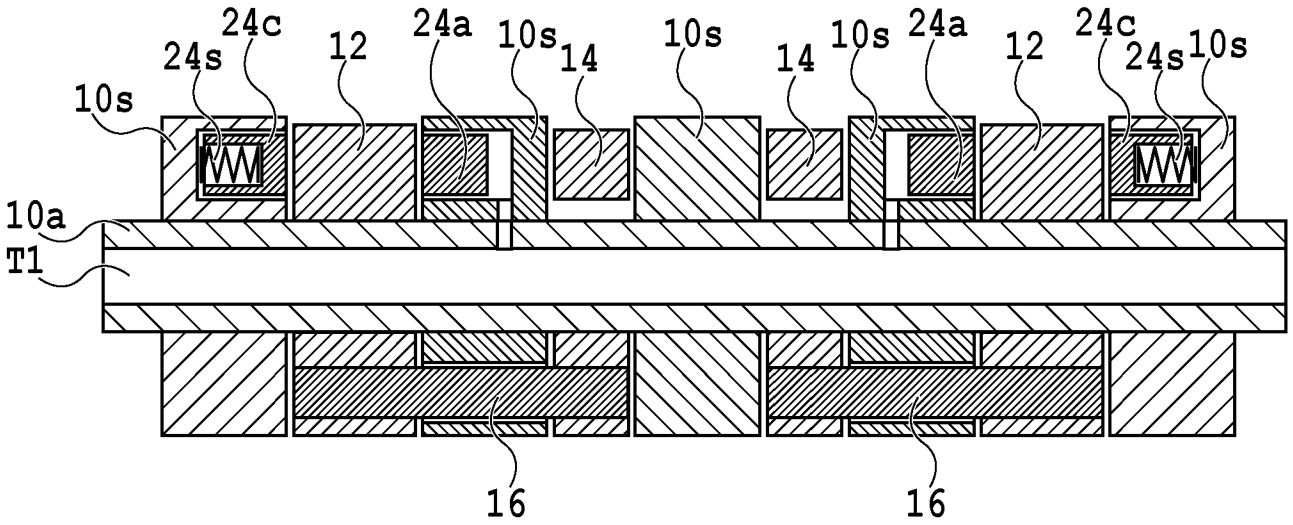
FIG. 12 is a diagram illustrating a state where the cam lobe member and the drive member have moved from the state in FIG. 11 to the retreat position in the cross section of FIG. 10.

Here, an explanation will be made of the fixing mechanism or fixing apparatus 24 for fixing the cam lobe member 12 to the cam base member 10 with reference to FIGS. 10 to 12. FIG. 10 is a schematic cross section illustrating the internal structure of the cam unit CU in a location along the X-X line in FIG. 3. For easy understanding, a part of the pressing apparatus 20 is illustrated in a virtual line in FIG. 10. In FIG. 10, the two cam lobe members 12 are in the fixing state, but as can be understood from FIG. 3, in this cross section it is actually not clear that the cam lobe member 12 projects radially. However, for easy understanding, in FIG. 10 the cam lobe member 12 is expressed such that the cam part 12*a* projects.

An inner shaft part 10*a* axially extends, and an oil passage T1 is formed along the axis of the inner shaft part 10*a*. The axial oil passage T1 is connected to a radial oil passage T2 extending from the axial direction to the radial direction outside. The radial oil passage T2 further axially extends to the cam lobe member 12-side.

An oil control valve CV that is controllable by an electric control unit (ECU) as a control apparatus is provided in the upstream side of the oil passage T1. When the oil control valve CV opens, the oil supplied from an unillustrated oil pan by an oil pump P can flow in the supply oil passage T1. The oil pump P is a mechanical pump interlocking with the crank shaft of the internal combustion engine, but may be an electrical pump.

The ECU is substantially configured as a computer including a computation processing device (for example, CPU), a memory device (for example, ROM and RAM), an A/D converter, an input interface, an output interface and the like. Various sensors are connected electrically to the input interface. The ECU electrically outputs operating signals or drive signals from the output interface such that a smooth drive or operation of the internal combustion engine is performed according to preset programs and the like, based on signals from the various sensors. In this way, the ECU controls an operation of an unillustrated fuel injection valve and the like, and besides, the oil control valve CV. Here, an explanation will be specifically made of some of the sensors. There is provided an engine rotating speed sensor 30 for detecting engine rotating speeds. In addition, there is provided an engine load sensor 32 for detecting engine loads. It should be noted that a throttle opening sensor, an accelerator pedal position sensor, an air flow meter, an intake pressure sensor or the like may be used as the engine load sensor 32.

The fixing apparatus 24 has a plurality of pins acting on the cam lobe member 12. Here, three pins 24*a*, 24*b*, 24*c* are used for fixing one cam lobe member 12. The three pins 24*a*, 24*b*, 24*c* are serially arranged in the order from the pin closer to the oil passage T1 in the flow passage direction. The pin 24*c* in the deepest side is urged to a radial oil passage T2-side by a spring 24*s*. With the urging force by the spring 24*s*, the pins 24*b*, 24*c* are positioned to be subjected to shear forces from the cam base member 10 and the cam lobe member 12 as illustrated in FIG. 10.

A fixing pin hole 12*j* of the cam lobe member 12 is provided in the backward end 12*c* of the cam lobe member 12, and is designed to have a size in which the middle pin 24*b* of the three pins is accommodated exactly therein. A pin hole 10*f* of the sub cam base member 10*s* in the corresponding drive member 14-side has an axial width longer than the axial width of the pin 24*a*. Further, a pin hole 10*g* of the sub cam base member 10*s* in the first spring 19-side is formed in a size in which the pin 24*c* is substantially accommodated exactly therein when the spring 24*s* is compressed.

As illustrated in FIG. 10, when oil pressures of a predetermined value or more are not applied to the oil passage, the pins 24*a*, 24*b*, 24*c* are respectively arranged not to be in alignment with the corresponding pin holes by the urging force of the spring 24*s*. Therefore the shear force is applied to each of the pins 24*b*, 24*c* to fix the cam lobe member 12. Accordingly it is possible to drive the rocker arm R with the cam part 12*a* of the cam lobe member 12. It should be noted that the fixing pin hole 12*j* of the cam lobe member 12 is designed such that the cam lobe member 12 is positioned in the above projecting position corresponding to one end side in the swingable range in the fixing state in FIG. 10.

On the other hand, at the time of stopping the drive of the rocker arm R by the cam lobe member 12, the ECU controls the oil control valve CV to open. Therefore as illustrated by an arrow in FIG. 11, hydraulic pressures of a predetermined value or more are applied to the pin 24*a* through each of the oil passages T1, T2. As a result, the spring 24*s* is compressed for the pins 24*a*, 24*b*, 24*c* to be respectively accommodated in the corresponding pin holes. As the fixing apparatus 24 becomes in the state in FIG. 11, the drive member 14 and the cam lobe member 12 both can move toward the corresponding retreat positions by pressing the pressed part 14*a* of the drive member 14 with the lifter 20*a* as illustrated in FIG. 8. FIG. 12 schematically illustrates a state where the cam lobe member 12 is away in the retreat position side from the projecting position. While such hydraulic pressure is applied, the cam lobe member 12 continues to swing between the projecting position and the retreat position. It should be noted that in a cross section in FIG. 12, as a result of the swinging of the cam lobe member 12, since the pin hole 12*j* is away from the location along the X-X line in FIG. 3 to be shifted from the other pin holes 10*f*, 10*g*, the pin 24*b* does not appear. It should be noted that in FIG. 12, as the cam lobe member 12 is illustrated to be closer to the retreat position, the cam lobe member 12 and the drive member 14 both are schematically illustrated.

In addition, the hydraulic pressure is released (supply of hydraulic pressures of a predetermined value or more is stopped), and when the cam lobe member 12 reaches the projecting position and the fixing pin hole 12*j* of the cam lobe member 12 is axially aligned to the pin hole 10*f* and the pin hole 10*g*, the pin 24*a*, 24*b*, 24*c* are moved by the urging force of the spring 24*s*. Therefore the cam lobe member 12 is maintained in a fixing state to the projecting position (refer to FIG. 10).

Figure 13:
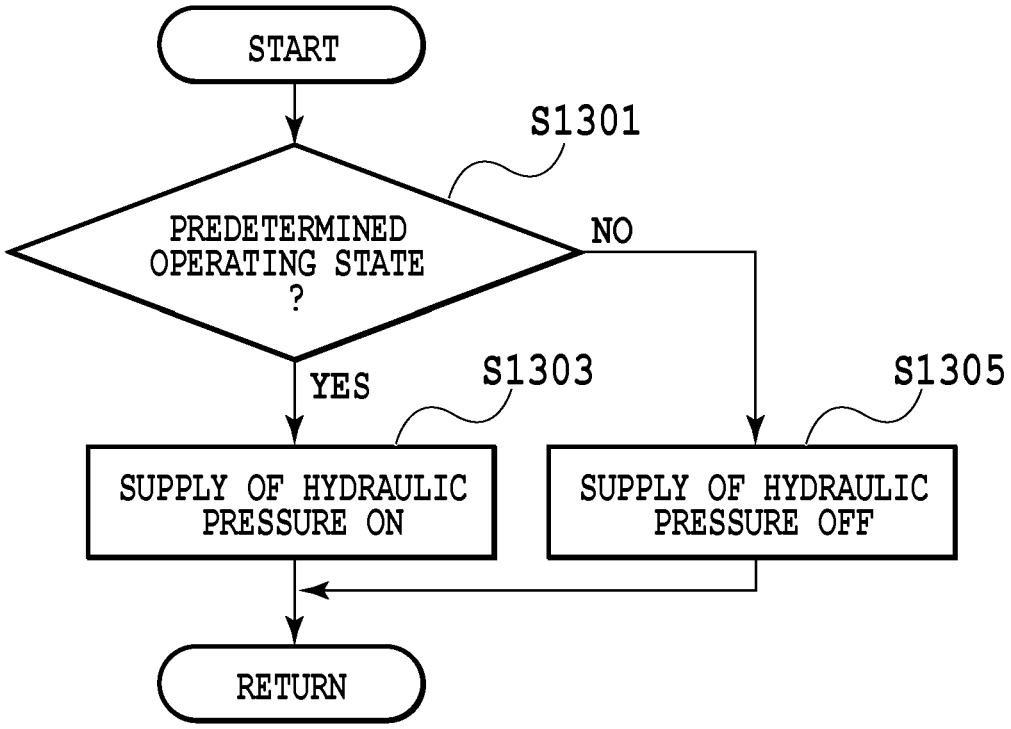
FIG. 13 is a flow chart for controlling the cam lobe member in the variable valve apparatus in FIG. 3.

An explanation will be made of a switching control of the oil control valve CV with reference to a flow chart in FIG. 13. First, at step S1301 it is determined whether or not the present operating state of the internal combustion engine is a predetermined operating state. Here, the ECU retrieves preset data or performs a predetermined computation based upon an engine rotating speed detected by the engine rotating speed sensor 30 and an engine load detected by the engine load sensor 32 to determine whether the present operating state is the predetermined operating state. The internal combustion engine in the present embodiment is a four-cylinder engine, and can perform a reduced-cylinder operation in which two cylinders are in a resting state in a predetermined operating state having a low engine load. In this internal combustion engine, the above variable valve apparatus is applied to each of the reduced-cylinder operating cylinders. Therefore the predetermined operating state is set as the operating state in which the reduced-cylinder operation is performed. However, the present invention allows the predetermined operating state to be the other operating state. It should be noted that the cylinder number and the like of the internal combustion engine to which the present invention is applied are not limited to those of the present embodiment, but the reduced cylinder operation in which the two cylinders in the four-cylinder engine are rested is just an example.

When at step S1301 a positive determination is made because of the predetermined operating state, at step S1303 supply of the hydraulic pressure is ON. That is, the ECU controls the oil control valve CV to open to a first predetermined opening (for example, a fully opened state). The first predetermined opening may be fixed or variable, and is set to supply the hydraulic pressure of the predetermined value or more. As a result, the fixing pins 24*a*, 24*b*, 24*c* of the cam unit CU are, for example, in the states in FIG. 11 and FIG. 12, wherein the opening of the valve is stopped.

On the other hand, when at step S1301 a negative determination is made because of the non-predetermined operating state, at step S1305 supply of the hydraulic pressure is OFF. That is, the ECU controls the oil control valve CV to close to a second predetermined opening (for example, a fully closed state). The second predetermined opening may be fixed or variable, and is set such that the hydraulic pressure of a predetermined value or more is not supplied to the pin 24*a*, particularly such that the cam lobe member can be returned to the state illustrated in FIG. 10. As a result, the cam unit CU is in the state illustrated in FIG. 10, wherein the valve starts to open.

Here, back to FIG. 8, an explanation will be made further of the movement of the drive member 14 when the cam lobe member 12 is not fixed to the cam base member 10. In FIG. 8, when the support shaft 16 reaches the closest position to the rocker arm R with rotation of the cam shaft S in a direction indicated by the arrow in FIG. 8, the lifter 20*a* abuts on not only the outer surface (that is, the base circle part BC) of the cam base member 10 but also on the drive member 14. Therefore the concave curved part 14*f* of the pressed part 14*a* in the drive member 14 starts to be pressed by the lifter 20*a* (refer to (b-2) and (b-3)). Here, the urging force of the second spring 20*c* is set to be stronger than the urging force of the first spring 19. Therefore the drive member 14 is pressed in a direction oriented to the retreat position from the projecting position to start to rotate around the support shaft 16. In addition, the abutting section of the lifter 20*a* on the drive member 14 passes the concave curved part 14*f* and reaches the transition part 14*h*, and therefore the drive member 14 is positioned in the retreat position (refer to (b-4)). Further, when the camshaft S rotates, the abutting section of the lifter 20*a* on the drive member 14 moves along the convex curved part 14*g* (refer to (b-5)). At this time, the drive member 14 gradually and smoothly moves toward the projecting position to the cam base member 10. Then the drive member 14 reaches the projecting position, and is released from the contact state with the lifter 20*a*. It should be noted that the movement of the drive member 14 corresponds to the movement of the cam lobe member 12. However, the cam lobe member 12 and the drive member 14 are designed such that the cam lobe member 12 starts to come in contact with the rocker arm R and is released from the contact state for a period from the contact start to the contact end of the drive member 14 with the lifter 20*a* with rotation of the camshaft S, particularly per one rotation of the camshaft S when the cam lobe member 12 is fixed (refer to FIG. 8 and FIG. 9). It should be noted that here, the cam lobe member 12 is structured to act on the rocker arm R as a follower member connected to the valve V, but may include the structure of acting on the other member, for example, the engine valve itself.

Here, attention will be focused on FIG. 8. It is understood that in the state of (b-3) in the row (b) in FIG. 8, a tangential line L1 of the abutting section of the drive member 14 on the lifter 20*a* substantially acts as a tangential line of the base circle part BC as well. It is understood that in the state of (b-5) in the row (b) in FIG. 8, a tangential line L2 of the abutting section of the drive member 14 on the lifter 20*a* substantially acts as a tangential line of the base circle part BC as well. As a result, when the cam lobe member 12 is not fixed to the cam base member 10, the contact of the lifter 20*a* with the drive member 14 can start smoothly with rotation of the camshaft S. In addition, the contact of the lifter 20*a* with the drive member 14 can end smoothly with the further rotation of the camshaft S.

Figure 1A:
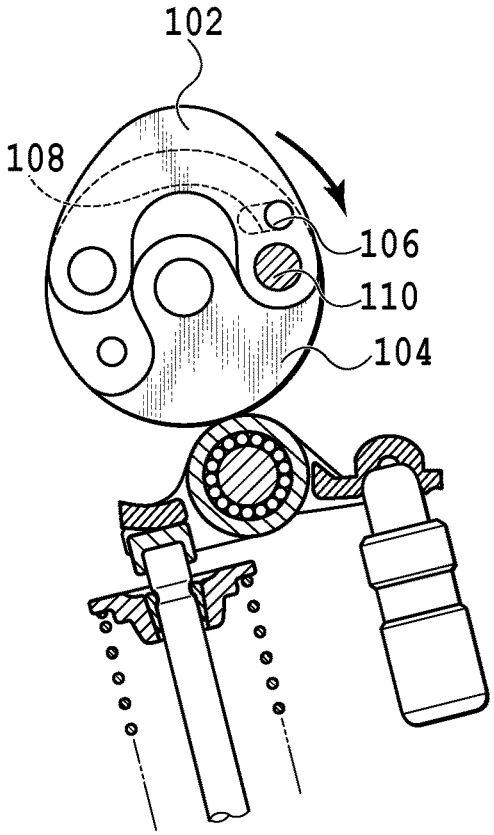
Figure 1B:
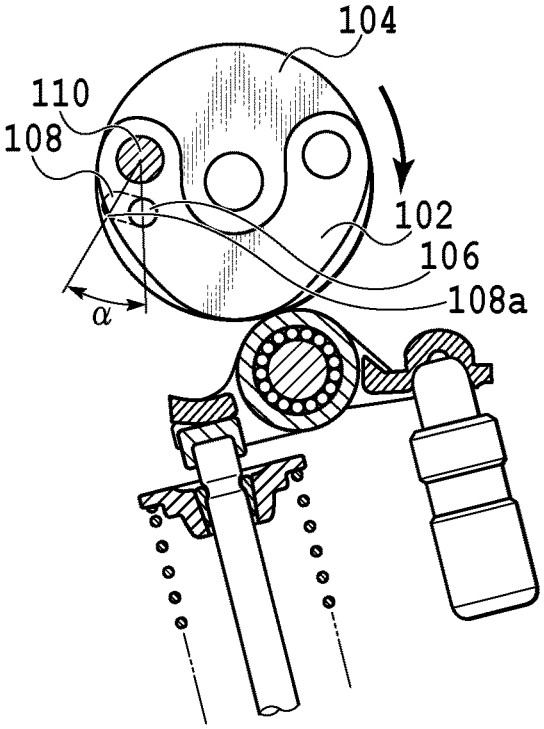
Figure 2B:
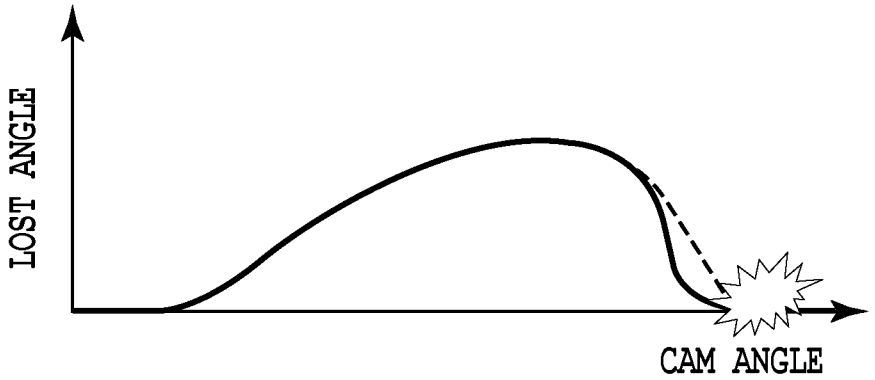
FIG. 2B is a graph for explaining the movement of the conventional cam lobe member.

The concave shape of the concave curved part 14*f* is recessed in a concave shape radially more than a section (for example, refer to a sign M1 in FIG. 8) on the outer peripheral surface at each of both sides of the maximum lift location M of the cam part 12*a* in the cam lobe member 12. Therefore the concave curved part 14*f* can abut firmly on the lifter 20*a* to continue to receive sufficient forces from the lifter 20*a*. In addition, the convex shape of the convex curved part 14*g* is swollen in a convex shape radially more than the section M1 on the outer peripheral surface at each of both sides of the maximum lift location M of the cam part 12*a* in the cam lobe member 12. Therefore the convex curved part 14*g* can abut firmly on the lifter 20*a* in the process of from (b-3) state to (b-5) state to continue to receive sufficient forces from the lifter 20*a*. Since the pressed part 14*a* of the drive member 14 is thus formed, as explained in FIG. 1 and FIG. 2 it is possible to suppress the cam lobe member 12 from rapidly moving (occurrence of the problem), thus making it possible to prevent various members from colliding with each other.

Further, in the above embodiment, the cam lobe member 12 is formed as a member separate from the drive member 14 for driving the cam lobe member 12 (although fixed to each other). Therefore it is possible to design the shape of the cam part 12*a* of the cam lobe member 12 and the shape of the pressed part 14*a* of the drive member 14 respectively at a higher degree of freedom. Accordingly it is possible to make the opening period of the valve V very long by the cam part 12*a* of the cam lobe member 12. Geometrically an action angle by the cam lobe member 12 can be increased to 360° at a crank angle CA. This is because when the cam lobe member 12 is in the non-fixed state, the cam lobe member 12 may be only retreated not to abut on the rocker arm, and it is allowed for a section of the cam lobe member 12 not opposing the rocker arm to project radially from the surface of the cam base member.

In addition, in the above embodiment, when the cam lobe member 12 is in the non-fixing state, the cam lobe member 12 swings only during a partial section in such a manner as to retreat only the cam part 12*a*. As a result, a period in which the cam lobe member 12 does not swing, that is, is in the projecting position, can be made long, although it depends upon the action angle. Therefore when the cam lobe member 12 is fixed by the fixing mechanism, the fixation possible period can be sufficiently secured.

Further, not the valve spring for the valve V but a special spring as the first spring 19 for the swinging of the cam lobe member 12 is used. Accordingly by selecting a resilient member having an appropriate resilient force as the first spring 19, it is possible to enhance the motion followability of the cam lobe member 12 when the engine rotating speed has a high rotation.

As described above, the first embodiment has been explained, but various alternations thereof are made possible. First, in the first embodiment, the support shaft 16 is disposed to be associated with the forward end 12*b* of the cam lobe member 12. However, the support shaft 16 may be arranged in the backward end 12*c* of the cam lobe member 12. However, preferably as in the case of the first embodiment, the support shaft 16 is arranged in the forward end 12*b* of the cam lobe member 12. The arrangement of the support shaft 16 in the forward end 12*b* enables the movement to the cam base member 10 of each of the cam lobe member 12 and the drive member 14 immediately before reaching the projecting position to be more gradual than the arrangement thereof in the backward end 12*c*. Therefore as described above, it is possible to prevent the collision of the stopper pin more appropriately.

Further, in the above embodiment, the pin of the fixing apparatus acts on the cam lobe member 12. However, since the cam lobe member 12 and the drive member 14 are fixed to each other, the fixing apparatus may be structured such that the pin of the fixing apparatus acts on the drive member 14. This can likewise be applied to the first spring. Further, in the fixing apparatus 24, when the hydraulic pressure is positively applied, the cam lobe member 12 is made swingable. However, the fixing apparatus may be altered such that when the hydraulic pressure is not positively applied, the cam lobe member 12 is made swingable. It should be noted that the number of the fixing pins in one cam lobe member 12 in the fixing apparatus is not limited to three, but may be one, two, four or more. Further, in the above embodiment, the first spring is mounted in the position to open outside of the axial end of the cam unit CU. However, the first spring may be arranged inside of the cam unit CU or in any other place. The first spring may be formed of various kinds of springs such as a torsion spring, a coil spring or the like as a resilient member (urging member).

Next, an explanation will be made of a second embodiment of the present invention. In the second embodiment, the variable valve apparatus of the present invention is applied to each of the intake valve and the exhaust valve. Hereinafter, only components characteristic in the second embodiment will be explained. Components identical to those already explained are referred to as identical reference signs, and the overlapping explanation is omitted.

Figure 14A:
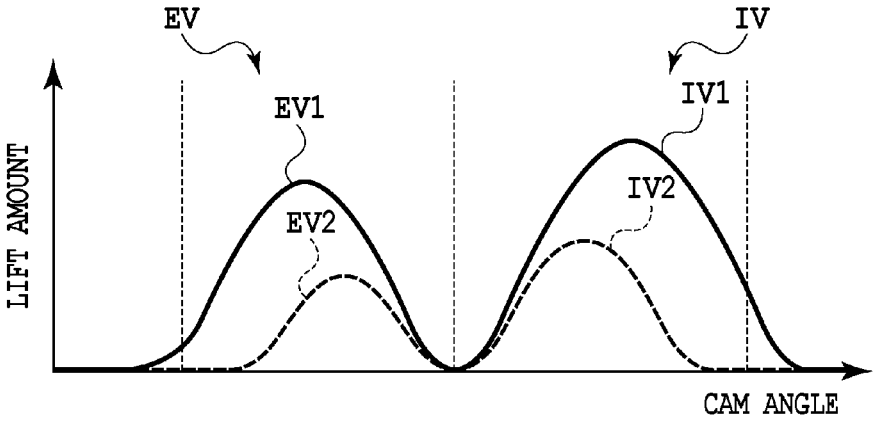

In the first embodiment, the cam base member 10 has the outer peripheral surface corresponding to the shape of the base circle part BC, and the lift amount of the valve by the cam base member 10 is zero. However, the cam base member may have an outer peripheral surface corresponding to a lift amount (first lift amount) that is smaller than a lift amount (second lift amount) by the cam lobe member 12, but is not zero, and the second embodiment has a cam base member 10 structured to realize the above structure. FIG. 14A is graph illustrating a lift curve EV—of an exhaust valve and a lift curve IV of an intake valve on the same time axis. It should be noted that the lift curve EV of the exhaust valve and the lift curve IV of the intake valve may partially overlap or may not overlap.

Figure 14B:
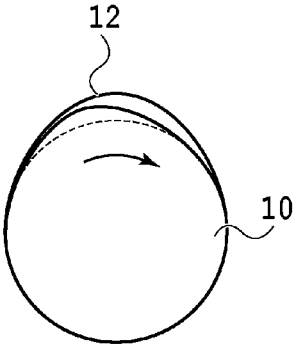

FIG. 14A illustrates two lift curves EV1, EV2 of the exhaust valve. The lift curve EV1 illustrated in a solid line is a lift curve at the time of driving the rocker arm by the cam lobe member 12, and the lift curve EV2 illustrated in a broken line is a lift curve at the time of driving the rocker arm by the outer surface of the cam base member 10. A relation between the cam base member 10 and the cam lobe member 12 of the cam unit for the exhaust valve having the structure adapted for the above characteristics is illustrated in FIG. 14B. In FIG. 14B, a reference base circle is illustrated in a broken line, and the cam base member 10 has a shape corresponding to the relatively small lift curve EV2. The cam lobe member 12 is illustrated such that a main cam part 12*d* partially projects out of the cam base member 10.

Figure 14C:
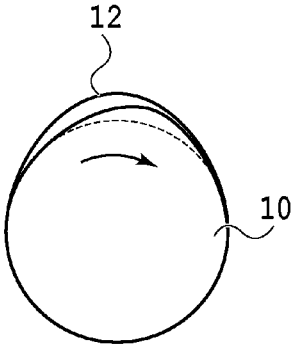

Further, FIG. 14A illustrates two lift curves IV1, IV2 of the intake valve. The lift curve IV1 illustrated in a solid line is a lift curve by the cam lobe member 12, and the lift curve IV2 illustrated in a broken line is a lift curve by the outer surface of the cam base member 10. A relation between the cam base member 10 and the cam lobe member 12 of the cam unit for the intake valve having the structure adapted for the above characteristics is illustrated in FIG. 14C. In FIG. 14C, the reference base circle is illustrated in a broken line, and the cam base member 10 has a shape corresponding to the relatively small lift curve IV2. The cam lobe member 12 is arranged such that a main cam part partially projects out of the cam base member 10.

As illustrated in FIG. 14A, the two lift curves EV1, EV2 of the exhaust valve overlap (or conform) in the closing side. Therefore when the cam lobe member 12 is in the projecting position, the closing-side section of the cam part 12*a* of the cam lobe member 12 conforms to the outer surface of the cam base member 10 as viewed in the axial direction of the camshaft S (refer to FIG. 14B). Likewise, as illustrated in FIG. 14A, the two lift curves IV1, IV2 of the intake valve overlap (or conform) in the opening side, and the opening-side section of the cam part 12*a* of the cam lobe member 12 in the projecting position conforms to the outer surface of the cam base member 10 as viewed in the axial direction of the camshaft S (refer to FIG. 14C).

Figure 15B:
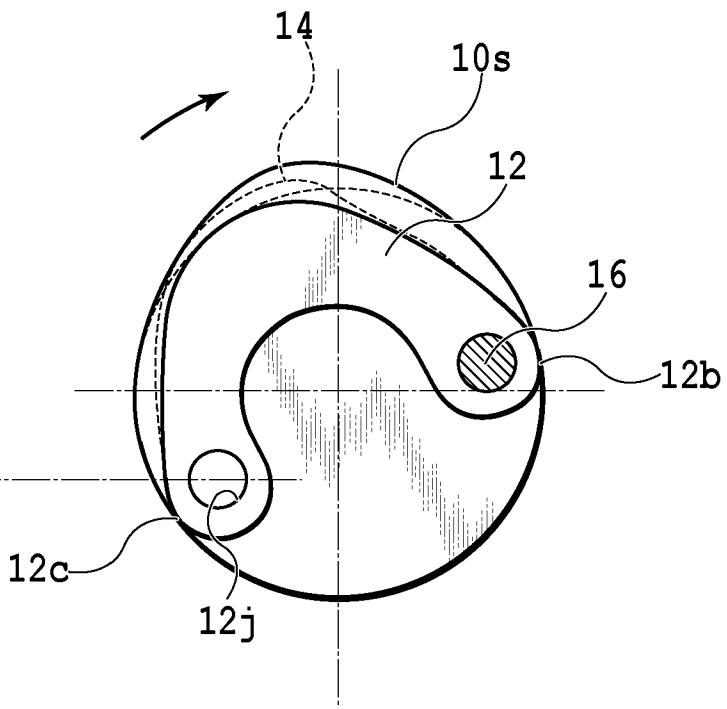
Figure 15A:
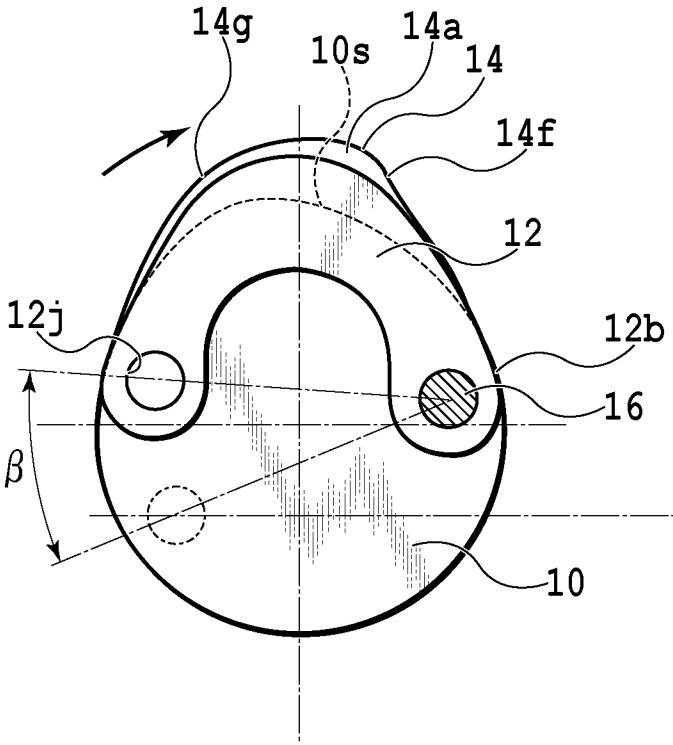

Here, FIG. 15A and FIG. 15B each illustrate a relation between the cam base member 10, the cam lobe member 12 and the drive member 14 of the cam unit for the exhaust valve. FIG. 15A illustrates a state where the cam lobe member 12 and the drive member 14 both are in the projecting position to the cam base member 10, and FIG. 15B illustrates a state where the cam lobe member 12 and the drive member 14 both are in the retreat position to the cam base member 10. As illustrated in FIG. 15A and FIG. 15B, the support shaft 16 is arranged in the forward end 12*b* of the two ends of the cam lobe member 12. It should be noted that an arrow in each of FIGS. 15A and 15B indicates a rotating direction of the cam shaft. In this way, in relation to the exhaust valve, the lift curve by the cam lobe member 12 and the lift curve by the cam base member 10 overlap in the closing side (refer to FIG. 14A), and the support shaft 16 is arranged in the opening-side end (the forward end) 12*b* of the cam part 12*a* of the cam lobe member 12 (refer to FIGS. 15A and 15B).

In relation to the intake valve, since the lift curve by the cam lobe member 12 and the lift curve by the cam base member 10 overlap in the opening side, the support shaft 16, although not illustrated, is arranged in the closing-side end (that is, the backward end) 12*c* of the cam part 12*a* of the cam lobe member 12.

Figure 16B:
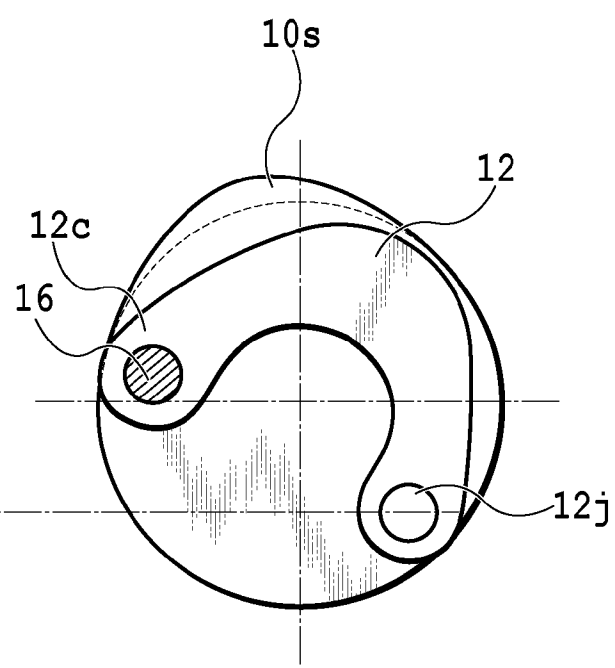
Figure 16A:
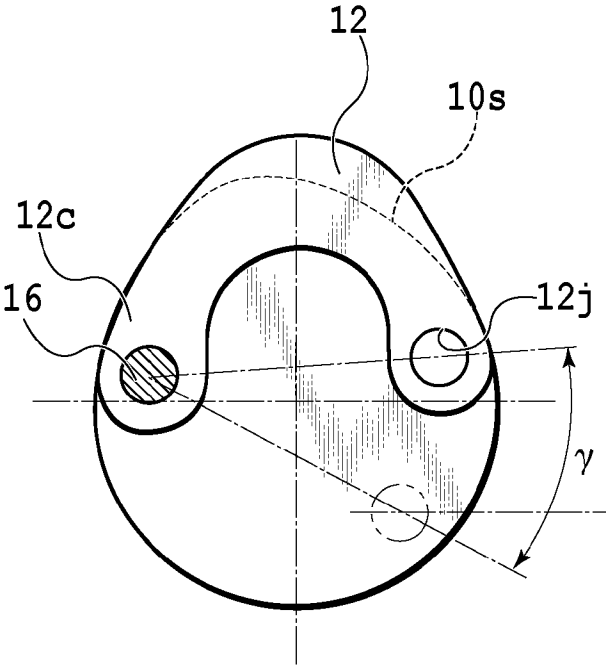

The arrangement position of the support shaft 16 is set to be selected to a side where a swinging angle (corresponding to the above lost angle $\alpha$) of the cam lobe member 12 around the support shaft 16 between the projecting position and the retreat position is relatively small (refer to an angle $\beta$ in FIG. 15A<an angle $\gamma$ in FIG. 16A). As a result, a range of the reciprocal motion of the cam lobe member 12 to the cam base member 10 is made relatively small. Therefore even in an operating region where the engine rotating speed is higher, it is possible to switch the lift amount of each valve more appropriately.

However, the cam unit of the exhaust valve, as illustrated in FIG. 16A and FIG. 16B (corresponding to FIGS. 15A and 15B respectively), may be structured such that the support shaft 16 is arranged in the closing-side end (that is, the backward end) 12*c* of the cam part 12*a* of the cam lobe member 12. In addition, the cam unit of the intake valve may be structured such that the support shaft is arranged in the forward end of the cam lobe member.

It should be noted that as illustrated in FIGS. 15A and 15B, since the cam base member 10 (sub cam base member 10*s*) has the outer peripheral surface shape corresponding to the first lift amount, in the second embodiment the shape of the outer peripheral surface of the pressed part 14*a* of the drive member 14 is changed to correspond to the shape of the cam base member 10. In this case also, the drive member 14, particularly the pressed part 14*a* thereof is designed to be provided with the concave curved part 14*f* closer to the support shaft 16 and the convex curved part 14*g* away from the concave curved part 14*f* in the circumferential direction.

Embodiments of the present invention include not only the aforementioned embodiments but also all modifications and applications, and its equivalents contained in the concept of the present invention defined by its claims. Therefore the present invention should not be interpreted in a limiting manner, and may be applied to any other techniques within the scope of the concept of the present invention.

What is claimed is:

1. A variable valve apparatus for an internal combustion engine that varies a lift amount of an engine valve comprising:

a cam base member that is provided in a cam shaft and rotates with rotation of the camshaft;

a cam lobe member that has a cam part and is provided to be movable between a projecting position where the cam part projects radially out of the cam base member and a retreat position where the cam part is retreated from a front surface of the cam base member in relation to the cam base member;

a first resilient member for urging the cam lobe member toward the projecting position, a movement control apparatus that is configured to control the movement of the cam lobe member to the cam base member and includes a drive member provided for driving the cam lobe member and a pressing part provided to add a pressing force to the drive member, the drive member being provided to be fixed to the cam lobe member and to be movable to the cam base member; and a fixing apparatus for selectively fixing the cam lobe member to the projecting position, wherein when the cam lobe member is in a non-fixing state to the cam base member, the cam lobe member is moved from the projecting position to the retreat position with the drive member being pressed by contact of the drive member with the pressing part.

2. The variable valve apparatus for the internal combustion engine according to claim 1, wherein when the cam lobe member is fixed by the fixing apparatus, the cam lobe member starts to come in contact with the engine valve or a follower member connected to the engine valve during a period from a contact start to a contact end of the drive member with the pressing part with rotation of the camshaft.

3. The variable valve apparatus for the internal combustion engine according to claim 1, wherein when the cam lobe member is fixed by the fixing apparatus, the cam lobe member is released from a contact state with the engine valve or a follower member connected to the engine valve during a period from a contact start to a contact end of the drive member with the pressing part with rotation of the camshaft.

4. The variable valve apparatus for the internal combustion engine according to claim 1, wherein the pressing part is urged to press the drive member by a second resilient member.

5. The variable valve apparatus for the internal combustion engine according to claim 4, wherein the urging force of the second resilient member to the drive member is larger than the urging force of the first resilient member to the cam lobe member.

6. The variable valve apparatus for the internal combustion engine according to claim 4, wherein when the cam lobe member is fixed in the projecting position by the fixing apparatus, the drive member moves the pressing part against the urging force of the second resilient member by contact with the pressing part.

7. The variable valve apparatus for the internal combustion engine according to claim 1, further comprising:

a regulating mechanism for regulating a movable range of the cam lobe member to the cam base member.

8. The variable valve apparatus for the internal combustion engine according to claim 1, wherein the cam lobe member is formed to have a forward end or a backward end in both sides of the cam part in the rotating direction of the camshaft and is movable around a supporting point member to the cam base member, and the supporting point member is arranged in any one of the forward end and the backward end.

9. The variable valve apparatus for the internal combustion engine according to claim 8, wherein the cam lobe member and the drive member are connected through the supporting point member, and the drive member comprises a concave curved part closer to the supporting point member and a convex curved part away from the concave curved part in the circumferential direction.

* * * * *